US008120255B2

(12) United States Patent
Kawarazaki et al.

(10) Patent No.: US 8,120,255 B2
(45) Date of Patent: Feb. 21, 2012

(54) PLASMA DISPLAY PANEL COMPRISING ELECTRIC CHARGE RETENTION PROPERTY

(75) Inventors: Hideji Kawarazaki, Osaka (JP); Kaname Mizokami, Kyoto (JP); Shinichiro Ishino, Osaka (JP); Koyo Sakamoto, Osaka (JP); Yuichiro Miyamae, Osaka (JP); Yoshinao Ooe, Kyoto (JP)

(73) Assignee: Panasonic Corporation, Osaka (JP)

( * ) Notice: Subject to any disclaimer, the term of this patent is extended or adjusted under 35 U.S.C. 154(b) by 205 days.

(21) Appl. No.: 12/520,917

(22) PCT Filed: Dec. 12, 2008

(86) PCT No.: PCT/JP2008/003731
§ 371 (c)(1),
(2), (4) Date: Jun. 23, 2009

(87) PCT Pub. No.: WO2009/113138
PCT Pub. Date: Sep. 17, 2009

(65) Prior Publication Data

US 2010/0327740 A1 Dec. 30, 2010

(30) Foreign Application Priority Data

Mar. 10, 2008 (JP) ..... 2008-058930

(51) Int. Cl.
*H01J 17/49* (2012.01)

(52) U.S. Cl. ..... 313/587; 313/584; 313/586

(58) Field of Classification Search ..... 313/582–587
See application file for complete search history.

(56) References Cited

U.S. PATENT DOCUMENTS

| | | | | |
|---|---|---|---|---|
| 5,917,284 | A * | 6/1999 | Moore et al. | 313/586 |
| 6,753,649 | B1 | 6/2004 | Bechtel et al. | |
| 7,786,957 | B2 * | 8/2010 | Sakata | 345/67 |
| 2005/0088095 | A1 | 4/2005 | Kim | |
| 2006/0284559 | A1 | 12/2006 | Naoi et al. | |

(Continued)

FOREIGN PATENT DOCUMENTS

| | | |
|---|---|---|
| CN | 1619752 | 5/2005 |

(Continued)

OTHER PUBLICATIONS

12520917_20110809_machine translation Yano JP 10-275563.*

(Continued)

*Primary Examiner* — Nimeshkumar Patel
*Assistant Examiner* — Jose M Diaz
(74) *Attorney, Agent, or Firm* — Wenderoth, Lind & Ponack, L.L.P.

(57) ABSTRACT

A plasma display panel (PDP) includes a front panel having a front glass substrate, a display electrode formed on the substrate, a dielectric layer formed to cover the display electrode, and a protective layer formed on the dielectric layer. Further, the PDP includes a rear panel facing the front panel so that a discharge space is formed, wherein the rear panel includes an address electrode in a direction intersecting the display electrode, and includes a barrier rib partitioning the discharge space. The PDP also includes a seal material providing a seal between the front panel and the rear panel at outer peripheries thereof. In the protective layer, a base film is formed on the dielectric layer and aggregated particles of metal oxide crystal particles are attached to the base film and distributed over a surface of a region inside the seal material.

5 Claims, 5 Drawing Sheets

U.S. PATENT DOCUMENTS

| | | | | |
|---|---|---|---|---|
| 2007/0126361 | A1* | 6/2007 | Lee | 313/586 |
| 2008/0024062 | A1* | 1/2008 | Kim et al. | 313/582 |
| 2008/0030137 | A1* | 2/2008 | Yoshioka et al. | 313/584 |
| 2008/0049382 | A1* | 2/2008 | Kasahara | 361/600 |
| 2008/0157671 | A1* | 7/2008 | Naoi et al. | 313/586 |
| 2008/0157673 | A1* | 7/2008 | Fukui et al. | 313/587 |
| 2009/0140652 | A1 | 6/2009 | Fukui et al. | |
| 2009/0146566 | A1 | 6/2009 | Fukui et al. | |
| 2010/0096986 | A1* | 4/2010 | Tsujita et al. | 313/582 |
| 2010/0213839 | A1* | 8/2010 | Yamaryo et al. | 313/587 |

FOREIGN PATENT DOCUMENTS

| | | |
|---|---|---|
| EP | 1 657 735 | 5/2006 |
| EP | 1 659 605 | 5/2006 |
| JP | 10-275563 | 10/1998 |
| JP | 11-339665 | 12/1999 |
| JP | 2002-260535 | 9/2002 |
| JP | 2006-59779 | 3/2006 |
| JP | 2006-147417 | 6/2006 |
| JP | 2006-244784 | 9/2006 |
| JP | 2007-48733 | 2/2007 |
| JP | 2008-021660 | 1/2008 |
| JP | 2008-21660 | 1/2008 |
| JP | 2008-91086 | 4/2008 |
| JP | 2008-293772 | 12/2008 |
| JP | 2008-293803 | 12/2008 |
| WO | WO 2007139183 A1 * | 12/2007 |

OTHER PUBLICATIONS

European Office Action issued Jan. 27, 2011 in Application No. 08 873 313.4.

International Search Report issued Feb. 17, 2009 in the International (PCT) Application No. PCT/JP2008/003731.

* cited by examiner

PLASMA DISPLAY PANEL COMPRISING ELECTRIC CHARGE RETENTION PROPERTY

This application is a U.S. National Phase Application of PCT International Application PCT/JP2008/003731.

TECHNICAL FIELD

The present invention relates to a plasma display panel used in a display device, and the like.

BACKGROUND ART

Since a plasma display panel (hereinafter, referred to as a "PDP") can realize a high definition and a large screen, 65-inch class televisions are commercialized. Recently, PDPs have been applied to high-definition television in which the number of scan lines is twice or more than that of a conventional NTSC method. Meanwhile, from the viewpoint of environmental problems, PDPs without containing a lead component have been demanded.

A PDP basically includes a front panel and a rear panel. The front panel includes a glass substrate of sodium borosilicate glass produced by a float process; display electrodes each composed of striped transparent electrode and bus electrode formed on one principal surface of the glass substrate; a dielectric layer covering the display electrodes and functioning as a capacitor; and a protective layer made of magnesium oxide (MgO) formed on the dielectric layer. On the other hand, the rear panel includes a glass substrate; striped address electrodes formed on one principal surface of the glass substrate; a base dielectric layer covering the address electrodes; barrier ribs formed on the base dielectric layer; and phosphor layers formed between the barrier ribs and emitting red, green and blue light, respectively.

The front panel and the rear panel are hermetically sealed so that the surfaces having electrodes face each other. Discharge gas of Ne—Xe is filled in discharge space partitioned by the barrier ribs at a pressure of 400 Torr to 600 Torr. The PDP realizes a color image display by selectively applying a video signal voltage to the display electrode so as to generate electric discharge, thus exciting the phosphor layer of each color with ultraviolet rays generated by the electric discharge so as to emit red, green and blue light (see patent document 1).

In such PDPs, the role of the protective layer formed on the dielectric layer of the front panel includes protecting the dielectric layer from ion bombardment due to electric discharge, emitting initial electrons so as to generate address discharge, and the like. Protecting the dielectric layer from ion bombardment is an important role for preventing a discharge voltage from increasing. Furthermore, emitting initial electrons so as to generate address discharge is an important role for preventing address discharge error that may cause flicker of an image.

In order to reduce flicker of an image by increasing the number of initial electrons from the protective layer, an attempt to add Si and Al into MgO has been made for instance.

Recently, televisions have realized higher definition. In the market, low cost, low power consumption and high brightness full HD (high definition) (1920×1080 pixels: progressive display) PDPs have been demanded. Since an electron emission property from a protective layer determines an image quality of a PDP, it is very important to control the electron emission property.

In PDPs, an attempt to improve the electron emission property has been made by mixing impurities in a protective layer.

However, when the electron emission property is improved by mixing impurities in the protective layer, electric charges accumulate on the surface of the protective layer, thus increasing a damping factor, that is, reducing electric charges to be used as a memory function with the passage of time. Therefore, in order to suppress this, it is necessary to take measures, for example, to increase a voltage to be applied. Thus, a protective layer should have two conflicting properties, high electron emission performance and a high electric charge retention property, i.e., a property of reducing the damping factor of electric charges as a memory function.

[Patent document 1] Japanese Patent Unexamined Publication No. 2007-48733

SUMMARY OF THE INVENTION

A PDP of the present invention includes a front panel including a substrate, a display electrode formed on the substrate, a dielectric layer formed so as to cover the display electrode, and a protective layer formed on the dielectric layer; a rear panel disposed facing the front panel so that discharge space is formed and including an address electrode formed in a direction intersecting the display electrode, and a barrier rib for partitioning the discharge space; and a seal material for sealing between the front panel and the rear panel at the outer peripheries thereof. The protective layer is formed by forming a base film on the dielectric layer and attaching aggregated particles of a plurality of aggregated crystal particles of metal oxide to the base film so that the aggregated particles are distributed over the entire surface of a region inside the seal material.

With such a configuration, a PDP having an improved electron emission property and an electric charge retention property and being capable of achieving a high image quality, low cost, and low voltage is provided. Thus, a PDP with low electric power consumption and high-definition and high-brightness display performance can be realized.

Furthermore, the aggregated particles are attached to the region inside the sealing material so that an outer edge portion of the region to which the aggregated particles are attached is located in a non-display area provided between an effective display area and the seal material. Thereby, leakage of discharge gas can be prevented.

REFERENCE MARKS IN THE DRAWINGS

Figure 1:
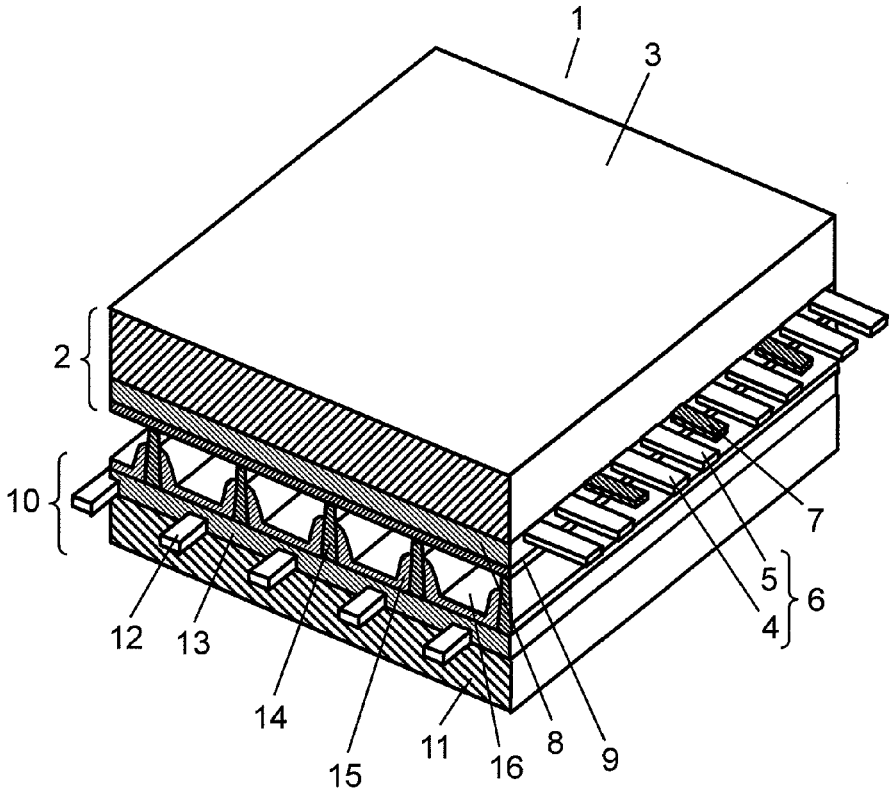
FIG. 1 is a perspective view showing a structure of a PDP in accordance with an exemplary embodiment of the present invention.

1 PDP
2 front panel
3 front glass substrate
4 scan electrode
4*a*, 5*a* transparent electrode
4*b*, 5*b* metal bus electrode
5 sustain electrode
6 display electrode
7 black stripe (light blocking layer)
8 dielectric layer
9 protective layer
10 rear panel
11 rear glass substrate
12 address electrode
13 base dielectric layer
14 barrier rib
15 phosphor layer
16 discharge space
17 seal material
18 display area
19 non-display area
81 first dielectric layer
82 second dielectric layer
91 base film
92 aggregated particles
92*a* crystal particle

DETAILED DESCRIPTION OF THE PREFERRED EMBODIMENT

Hereinafter, a PDP in accordance with an exemplary embodiment of the present invention is described with reference to drawings.

Exemplary Embodiment

FIG. 1 is a perspective view showing a structure of a PDP in accordance with the exemplary embodiment of the present invention. The basic structure of the PDP is the same as that of a general AC surface-discharge type PDP. As shown in FIG. 1, PDP 1 includes front panel 2 including front glass substrate 3, and the like, and rear panel 10 including rear glass substrate 11, and the like. Front panel 2 and rear panel 10 are disposed facing each other. The outer peripheries of PDP1 are hermetically sealed together with a sealing material made of a glass frit, and the like. In discharge space 16 inside the sealed PDP 1, discharge gas such as Ne and Xe is filled at a pressure of 400 Torr to 600 Torr.

On front glass substrate 3 of front panel 2, a plurality of display electrodes 6 each composed of a pair of band-like scan electrode 4 and sustain electrode 5 and black stripes (light blocking layers) 7 are disposed in parallel to each other. On glass substrate 3, dielectric layer 8 functioning as a capacitor is formed so as to cover display electrodes 6 and blocking layers 7. Furthermore, protective layer 9 made of, for example, magnesium oxide (MgO) is formed on the surface of dielectric layer 8.

Furthermore, on rear glass substrate 11 of rear panel 10, a plurality of band-like address electrodes 12 are disposed in parallel to each other in the direction orthogonal to scan electrodes 4 and sustain electrodes 5 of front panel 2, and base dielectric layer 13 covers address electrodes 12. In addition, barrier ribs 14 with a predetermined height for partitioning discharge space 16 are formed between address electrodes 12 on base dielectric layer 13. In grooves between barrier ribs 14, every address electrode 12, phosphor layers 15 emitting red, green and blue light by ultraviolet rays are sequentially formed by coating. Discharge cells are formed in positions in which scan electrodes 4 and sustain electrodes 5 intersect address electrodes 12. The discharge cells having red, green and blue phosphor layers 15 arranged in the direction of display electrode 6 function as pixels for color display.

Figure 2:
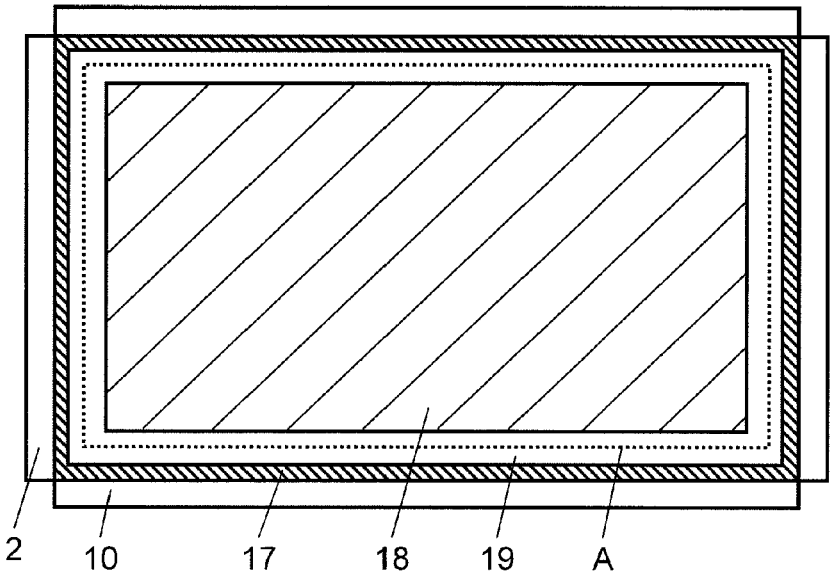
FIG. 2 is a perspective plan view showing the PDP.

FIG. 2 is a schematic plan view showing the thus configured PDP. As shown in FIG. 2, front panel 2 and rear panel 10 are sealed together at the outer peripheries thereof with seal material 17 made of glass frit. Thus, discharge space 16 is sealed. Furthermore, inside seal material 17, display area 18 for carrying out display and non-display area 19 between display area 18 and seal material 17 are provided. The region to which aggregated particles 92 are attached is shown by outer edge portion A of the region, which is described later.

Figure 3:
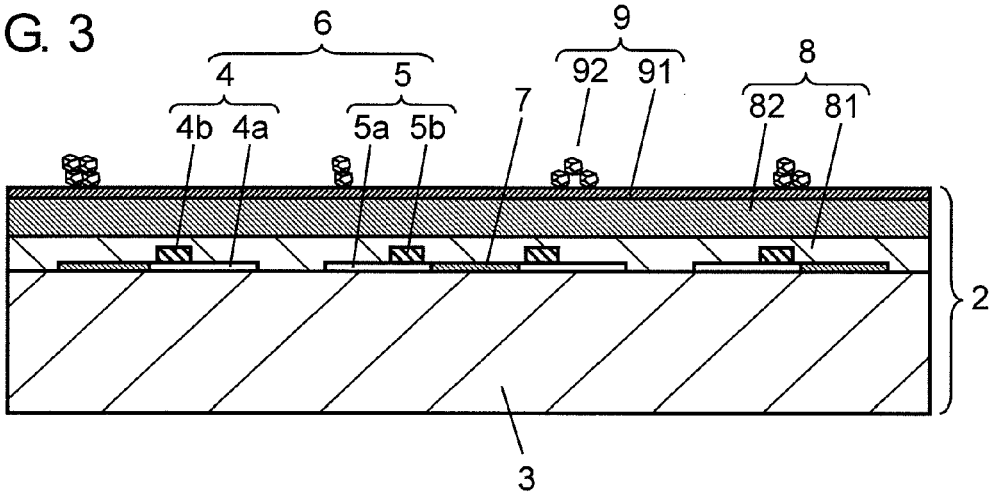
FIG. 3 is a sectional view showing a configuration of a front panel of the PDP.

FIG. 3 is a sectional view showing a configuration of front panel 2 of PDP 1 in accordance with the exemplary embodiment of the present invention. FIG. 3 is shown turned upside down with respect to FIG. 1. As shown in FIG. 3, display electrodes 6 each composed of scan electrode 4 and sustain electrode 5 and light blocking layers 7 are pattern-formed on front glass substrate 3 produced by, for example, a float method. Scan electrode 4 and sustain electrode 5 include transparent electrodes 4*a* and 5*a* made of indium tin oxide (ITO), tin oxide ($SnO_2$), or the like, and metal bus electrodes 4*b* and 5*b* formed on transparent electrodes 4*a* and 5*a*, respectively. Metal bus electrodes 4*b* and 5*b* are used for the purpose of providing the conductivity in the longitudinal direction of transparent electrodes 4*a* and 5*a* and formed of a conductive material containing a silver (Ag) material as a main component.

Dielectric layer 8 includes at least two layers, that is, first dielectric layer 81 and second dielectric layer 82. First dielectric layer 81 is provided for covering transparent electrodes 4*a* and 5*a*, metal bus electrodes 4*b* and 5*b* and light blocking layers 7 formed on front glass substrate 3. Second dielectric layer 82 is formed on first dielectric layer 81. In addition, protective layer 9 is formed on second dielectric layer 82. Protective layer 9 includes base film 91 formed on dielectric layer 8 and aggregated particles 92 attached to base film 91.

Next, a method of manufacturing a PDP is described. Firstly, scan electrodes 4, sustain electrodes 5 and light blocking layers 7 are formed on front glass substrate 3. Transparent electrodes 4*a* and 5*a* and metal bus electrodes 4*b* and 5*b* thereof are formed by patterning by, for example, a photolithography method. Transparent electrodes 4*a* and 5*a* are formed by, for example, a thin film process. Metal bus electrodes 4*b* and 5*b* are formed by firing a paste containing a silver (Ag) material at a predetermined temperature to be solidified. Furthermore, light blocking layer 7 is similarly formed by a method of screen printing a paste containing a black pigment, or a method of forming a black pigment over the entire surface of the glass substrate, then carrying out patterning by a photolithography method, and firing thereof.

Next, a dielectric paste is coated on front glass substrate 3 by, for example, a die coating method so as to cover scan electrodes 4, sustain electrodes 5 and light blocking layer 7, thus forming a dielectric paste layer (dielectric material layer). Since a dielectric paste is coated and then stood still for a predetermined time, the surface of the coated dielectric paste is leveled and flattened. Thereafter, the dielectric paste layer is fired and solidified, thereby forming dielectric layer 8 that covers scan electrode 4, sustain electrode 5 and light blocking layer 7. The dielectric paste is a coating material including a dielectric material such as glass powder, a binder and a solvent. Next, protective layer 9 made of magnesium oxide (MgO) is formed on dielectric layer 8 by a vacuum deposition method. In the above-mentioned steps, predetermined components, that is, scan electrode 4, sustain electrode 5, light blocking layer 7, dielectric layer 8, and protective layer 9 are formed on front glass substrate 3. Thus, front panel 2 is completed.

On the other hand, rear panel 10 is formed as follows. Firstly, a material layer as a component of address electrode 12 is formed on rear glass substrate 11 by, for example, a method of screen-printing a paste containing a silver (Ag) material, or a method of forming a metal film on the entire surface and then patterning it by a photolithography method. Then, the material layer is fired at a predetermined temperature. Thus, address electrode 12 is formed. Next, on rear glass substrate 11 on which address electrode 12 is formed, a dielectric paste is coated so as to cover address electrodes 12 by, for example, a die coating method. Thus, a dielectric paste layer is formed. Thereafter, by firing the dielectric paste layer, base dielectric layer 13 is formed. Note here that the dielectric paste is a coating material including a dielectric material such as glass powder, a binder, and a solvent.

Next, by coating a barrier rib formation paste containing a material for the barrier rib on base dielectric layer 13 and patterning it into a predetermined shape, a barrier rib material layer is formed. Then, the barrier rib material layer is fired to form barrier ribs 14. Herein, a method of patterning the barrier rib formation paste coated on base dielectric layer 13 may include a photolithography method and a sand-blast method. Next, a phosphor paste containing a phosphor material is coated on base dielectric layer 13 between neighboring barrier ribs 14 and on the side surfaces of barrier ribs 14 and fired. Thereby, phosphor layer 15 is formed. With the above-mentioned steps, rear panel 10 including rear glass substrate 11 provided with predetermined component members is completed.

In this way, front panel 2 and rear panel 10, which include predetermined component members, are disposed facing each other so that scan electrodes 4 and address electrodes 12 are disposed orthogonal to each other, and sealed together at the peripheries thereof with a glass frit. Discharge gas including, for example, Ne and Xe, is filled in discharge space 16. Thus, PDP 1 is completed.

Herein, first dielectric layer 81 and second dielectric layer 82 forming dielectric layer 8 of front panel 2 are described in detail. A dielectric material of first dielectric layer 81 includes the following material compositions: 20 wt. % to 40 wt. % of bismuth oxide ($Bi_2O_3$); 0.5 wt. % to 12 wt. % of at least one selected from calcium oxide (CaO), strontium oxide (SrO) and barium oxide (BaO); and 0.1 wt. % to 7 wt. % of at least one selected from molybdenum oxide ($MoO_3$), tungsten oxide ($WO_3$), cerium oxide ($CeO_2$), and manganese oxide ($MnO_2$).

Instead of molybdenum oxide ($MoO_3$), tungsten oxide ($WO_3$), cerium oxide ($CeO_2$) and manganese oxide ($MnO_2$), 0.1 wt. % to 7 wt. % of at least one selected from copper oxide (CuO), chromium oxide ($Cr_2O_3$), cobalt oxide ($Co_2O_3$), vanadium oxide ($V_2O_7$) and antimony oxide ($Sb_2O_3$) may be included.

Furthermore, components other than the above-mentioned components may include material compositions, for example, 0 wt. % to 40 wt. % of zinc oxide (ZnO), 0 wt. % to 35 wt. % of boron oxide ($B_2O_3$), 0 wt. % to 15 wt. % of silicon oxide ($SiO_2$) and 0 wt. % to 10 wt. % of aluminum oxide ($Al_2O_3$), which do not include a lead component. The contents of such material compositions are not particularly limited and may be around the range of those in conventional technologies.

The dielectric materials including these composition components are ground to have an average particle diameter of 0.5 μm to 2.5 μm by using a wet jet mill or a ball mill to form dielectric material powder. Then, 55 wt % to 70 wt % of the dielectric material powders and 30 wt % to 45 wt % of binder components are well kneaded by using a three-roller to form a paste for the first dielectric layer to be used in die coating or printing.

The binder component is ethyl cellulose, or terpineol containing 1 wt % to 20 wt % of acrylic resin, or butyl carbitol acetate. Furthermore, in the paste, if necessary, at least one of dioctyl phthalate, dibutyl phthalate, triphenyl phosphate and tributyl phosphate may be added as a plasticizer; and at least one of glycerol monooleate, sorbitan sesquioleate, Homogenol (Kao Corporation), an alkylallyl phosphate, and the like may be added as a dispersing agent, so that the printing property may be improved.

Next, this first dielectric layer paste is printed on front glass substrate 3 by a die coating method or a screen printing method so as to cover display electrodes 6 and dried, followed by firing at a temperature of 575° C. to 590° C., that is, a slightly higher temperature than the softening point of the dielectric material.

Next, second dielectric layer 82 is described. A dielectric material of second dielectric layer 82 includes the following material compositions: 11 wt. % to 20 wt. % of bismuth oxide ($Bi_2O_3$); furthermore, 1.6 wt. % to 21 wt. % of at least one selected from calcium oxide (CaO), strontium oxide (SrO), and barium oxide (BaO); and 0.1 wt. % to 7 wt. % of at least one selected from molybdenum oxide ($MoO_3$), tungsten oxide ($WO_3$), and cerium oxide ($CeO_2$).

Instead of molybdenum oxide ($MoO_3$), tungsten oxide ($WO_3$) and cerium oxide ($CeO_2$), 0.1 wt. % to 7 wt. % of at least one selected from copper oxide (CuO), chromium oxide ($Cr_2O_3$), cobalt oxide ($Co_2O_3$), vanadium oxide ($V_2O_7$), antimony oxide ($Sb_2O_3$) and manganese oxide ($MnO_2$) may be included.

Furthermore, as components other than the above-mentioned components, material compositions, for example, 0 wt. % to 40 wt. % of zinc oxide (ZnO), 0 wt. % to 35 wt. % of boron oxide ($B_2O_3$), 0 wt. % to 15 wt. % of silicon oxide ($SiO_2$) and 0 wt. % to 10 wt. % of aluminum oxide ($Al_2O_3$), which do not contain a lead component, may be included. The contents of such material compositions are not particularly limited and may be around the range of those in conventional technologies.

The dielectric materials including these composition components are ground to have an average particle diameter of 0.5 μm to 2.5 μm by using a wet jet mill or a ball mill to form dielectric material powder. Then, 55 wt % to 70 wt % of the dielectric material powders and 30 wt % to 45 wt % of binder components are well kneaded by using a three-roller to form a paste for the second dielectric layer to be used in die coating or printing. The binder component is ethyl cellulose, or terpineol containing 1 wt % to 20 wt % of acrylic resin, or butyl carbitol acetate. Furthermore, in the paste, if necessary, dioctyl phthalate, dibutyl phthalate, triphenyl phosphate and tributyl phosphate may be added as a plasticizer; and glycerol monooleate, sorbitan sesquioleate, Homogenol (Kao Corporation), an alkylallyl phosphate, and the like, may be added as a dispersing agent so that the printing property may be improved.

Next, this second dielectric layer paste is printed on first dielectric layer 81 by a screen printing method or a die coating method and dried, followed by firing at a temperature of 550° C. to 590° C., that is, a slightly higher temperature than the softening point of the dielectric material.

Note here that it is preferable that the film thickness of dielectric layer 8 in total of first dielectric layer 81 and second dielectric layer 82 is not more than 41 μm in order to secure the visible light transmittance. In first dielectric layer 81, in order to suppress the reaction between metal bus electrodes 4*b* and 5*b* and silver (Ag), the content of bismuth oxide ($Bi_2O_3$) is set to be 20 wt % to 40 wt %, which is higher than the content of bismuth oxide in second dielectric layer 82. Therefore, since the visible light transmittance of first dielectric layer 81 becomes lower than that of second dielectric layer 82, the film thickness of first dielectric layer 81 is set to be thinner than that of second dielectric layer 82.

In second dielectric layer 82, it is not preferable that the content of bismuth oxide ($Bi_2O_3$) is not more than 11 wt % because bubbles tend to be generated in second dielectric layer 82 although coloring does not easily occur. Furthermore, it is not preferable that the content is more than 40 wt % for the purpose of increasing the transmittance because coloring tends to occur.

As the film thickness of dielectric layer 8 is smaller, the effect of improving the panel brightness and reducing the discharge voltage is more remarkable. Therefore, it is desirable that the film thickness is set to be as small as possible within a range in which withstand voltage is not reduced. From such a viewpoint, in the exemplary embodiment of the present invention, the film thickness of dielectric layer 8 is set to be not more than 41 μm, that of first dielectric layer 81 is set to be 5 μm to 15 μm, and that of second dielectric layer 82 is set to be 20 μm to 36 μm.

In the thus manufactured PDP, even when a silver (Ag) material is used for display electrode 6, it is confirmed that less coloring phenomenon (yellowing) of front glass substrate 3 occurs, bubbles are not generated in dielectric layer 8 and dielectric layer 8 having excellent withstand voltage performance can be realized.

Next, in the PDP in accordance with the exemplary embodiment of the present invention, the reason why these dielectric materials suppress the generation of yellowing or bubbles in first dielectric layer 81 is considered. That is to say, it is known that by adding molybdenum oxide ($MoO_3$) or tungsten oxide ($WO_3$) to dielectric glass containing bismuth oxide ($Bi_2O_3$), compounds such as $Ag_2MoO_4$, $Ag_2Mo_2O_7$, $Ag_2Mo_4O_{13}$, $Ag_2WO_4$, $Ag_2W_2O_7$, and $Ag_2W_4O_{13}$ are easily generated at such a low temperature as not higher than 580° C. In this exemplary embodiment of the present invention, since the firing temperature of dielectric layer 8 is 550° C. to 590° C., silver ions ($Ag^+$) dispersing in dielectric layer 8 during firing react with molybdenum oxide ($MoO_3$), tungsten oxide ($WO_3$), cerium oxide ($CeO_2$), and manganese oxide ($MnO_2$) in dielectric layer 8 so as to generate a stable compound and are stabilized. That is to say, since silver ions ($Ag^+$) are stabilized without undergoing reduction, they do not aggregate to form a colloid. Consequently, silver ions ($Ag^+$) are stabilized, thereby reducing the generation of oxygen accompanying the formation of colloid of silver (Ag). Thus, the generation of bubbles in dielectric layer 8 is reduced.

On the other hand, in order to make these effects be effective, it is preferable that the content of molybdenum oxide ($MoO_3$), tungsten oxide ($WO_3$), cerium oxide ($CeO_2$), and manganese oxide ($MnO_2$) in the dielectric glass containing bismuth oxide ($Bi_2O_3$) is not less than 0.1 wt. %. It is more preferable that the content is not less than 0.1 wt. % and not more than 7 wt. %. In particular, it is not preferable that the content is less than 0.1 wt. % because the effect of suppressing yellowing is reduced. Furthermore, it is not preferable that the content is more than 7 wt. % because coloring occurs in the glass.

That is to say, in dielectric layer 8 of the PDP in accordance with the exemplary embodiment of the present invention, the generation of yellowing phenomenon and bubbles is suppressed in first dielectric layer 81 that is brought into contact with metal bus electrodes 4*b* and 5*b* made of a silver (Ag) material, and high light transmittance is realized by second dielectric layer 82 formed on first dielectric layer 81. As a result, it is possible to realize a PDP in which dielectric layer 8 as a whole has extremely reduced generation of bubbles and yellowing and which has high transmittance.

Next, as the feature in accordance with the exemplary embodiment of the present invention, a configuration and a manufacturing method of a protective layer are described.

Figure 4:
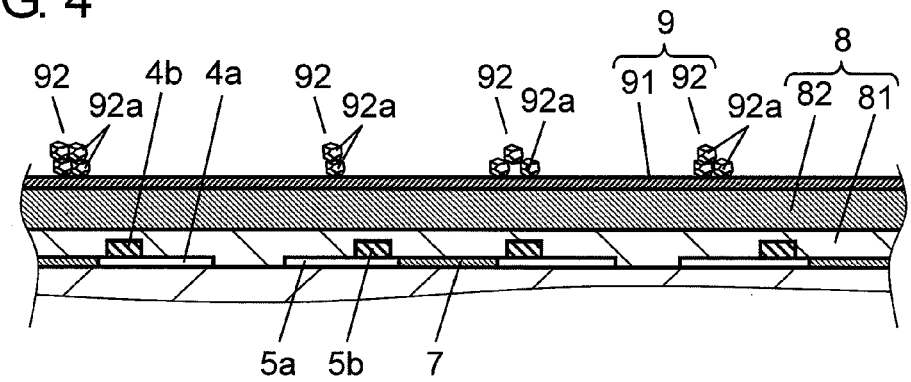
FIG. 4 is an enlarged sectional view showing a protective layer part of the PDP.

In the PDP in accordance with the exemplary embodiment of the present invention, as shown in FIG. 4, protective layer 9 includes base film 91 and aggregated particles 92. Base film 91 made of MgO containing Al as an impurity is formed on dielectric layer 8. Aggregated particles 92 of a plurality of aggregated crystal particles 92*a* of MgO as metal oxide are discretely scattered (e.g., located apart from one another) on base film 91 so that aggregated particles 92 can be distributed over the entire surface substantially uniformly.

Furthermore, as shown in FIG. 2, aggregated particles 92 are attached to a region inside sealing material 17 so that outer edge portion A of a region to which aggregated particles 92 are attached is located in non-display area 19 provided between display area 18 and seal material 17. Since outer edge portion A of the region to which aggregated particles 92 are attached is thus limited, aggregated particles 92 are not attached to a portion to be sealed with seal material 17. Therefore, since aggregated particles 92 do not exist in the sealed portion of front panel 2 and rear panel 10, leakage of discharge gas caused by aggregated particles 92 does not occur.

Figure 5:
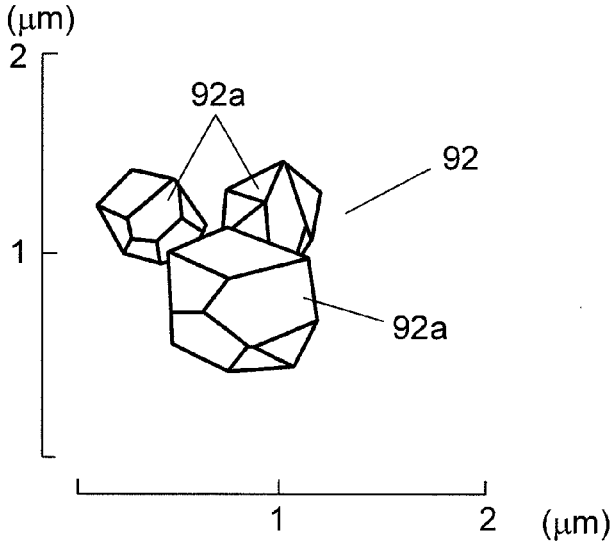
FIG. 5 is an enlarged view illustrating aggregated particles in the protective layer of the PDP.

Herein, aggregated particle 92 is a state in which crystal particles 92*a* having a predetermined primary particle diameter are aggregated or necked as shown in FIG. 5. In aggregated particles 92, a plurality of primary particles are not bonded as a solid form with a large bonding strength but they are combined as an assembly structure by static electricity, Van der Waals force, or the like. That is to say, a part or all of crystal particles 92*a* are combined by an external stimulation such as ultrasonic wave to such a degree that they are in a state of primary particles. The particle diameter of aggregated particles 92 is about 1 μm. It is desirable that crystal particle 92*a* has a shape of polyhedron having seven faces or more, for example, truncated octahedron and dodecahedron.

Furthermore, the primary particle diameter of crystal particle 92*a* of MgO can be controlled by the production condition of crystal particle 92*a*. For example, when crystal particle 92*a* of MgO is produced by firing an MgO precursor such as magnesium carbonate or magnesium hydroxide, the particle diameter can be controlled by controlling the firing temperature or firing atmosphere. In general, the firing temperature can be selected in the range from about 700° C. to about 1500° C. When the firing temperature is set to be such a relatively high temperature as not less than 1000° C., the primary particle diameter can be controlled to about 0.3 to 2 μm. Furthermore, when crystal particle 92*a* is obtained by heating an MgO precursor, it is possible to obtain aggregated particles 92 in which a plurality of primary particles are combined by aggregation or a phenomenon called necking during production process.

Next, results of experiments carried out for confirming the effect of the PDP having the protective layer in accordance with the exemplary embodiment of the present invention are described.

Figure 6:
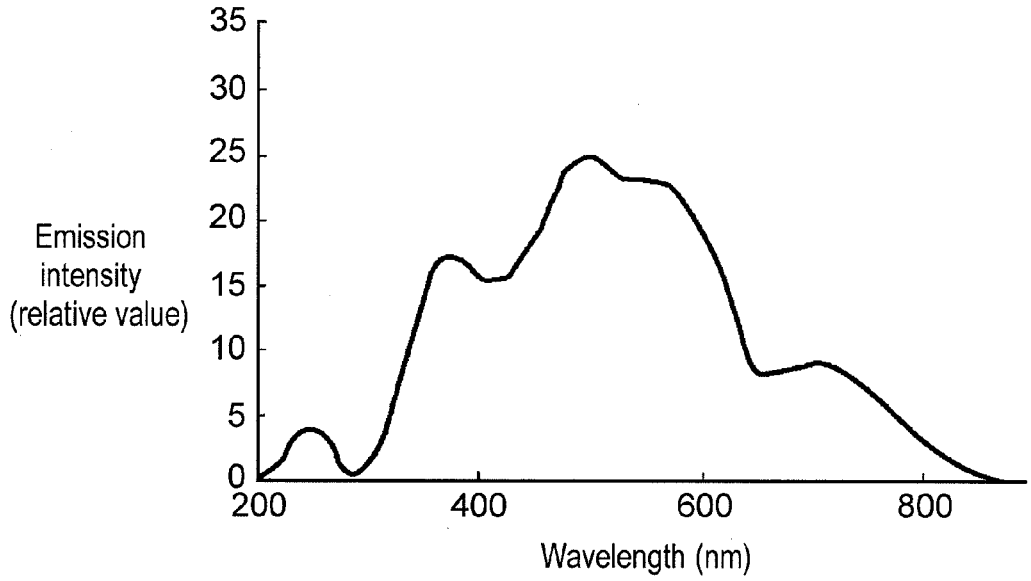
FIG. 6 is a graph showing a measurement result of cathode luminescence of a crystal particle.

Firstly, PDPs including protective layers having different configurations are made as trial products. Trial product 1 is a PDP including only a protective layer made of MgO. Trial product 2 is a PDP including a protective layer made of MgO doped with impurities such as Al and Si. Trial product 3 is a PDP in which only primary particles of metal oxide crystal particles are scattered and attached to a base film made of MgO. Trial product 4 is a product of the present invention and is a PDP in which aggregated particles of a plurality of aggregated crystal particles are attached to a base film made of MgO so that the aggregated particles are distributed over the entire surface of the base film substantially uniformly. In trial products 3 and 4, as the metal oxide, single crystal particles of MgO are used. Furthermore, in trial product 4 in accordance with the present invention, when the cathode luminescence of the crystal particles attached to the base film is measured, trial product 4 has a property of the emission intensity vs. wavelength shown in FIG. 6. Note here that the emission intensity is expressed by relative values.

PDPs having these four kinds of configurations of protective layers are examined for the electron emission performance and the electric charge retention performance.

When the electron emission performance is expressed by a larger value, the amount of emitted electrons is lager. The electron emission performance is expressed by the initial electron emission amount determined by the surface state by discharge, kinds of gases and the state thereof. The initial electron emission amount can be measured by a method of measuring the amount of electron current emitted from a surface after the surface is irradiated with ions or electron beams. However, it is difficult to evaluate the front panel surface in a nondestructive way. Therefore, as described in Japanese Patent Unexamined Publication No. 2007-48733, the value called a statistical lag time among lag times at the time of discharge, which is an index showing the discharging tendency, is measured. By integrating the inverse number of the value, a numeric value linearly corresponding to the initial electron emission amount can be obtained. Herein, the thus obtained value is used to evaluate the electron emission amount. This lag time at the time of discharge means a time of discharge delay in which discharge is delayed from the rising time of the pulse. The main factor of this discharge delay is thought to be that the initial electron functioning as a trigger is not easily emitted from a protective layer surface toward discharge space when discharge is started.

Furthermore, the electric charge retention performance is represented by using, as its index, a value of a voltage applied to a scan electrode (hereinafter, referred to as "Vscn lighting voltage") necessary to suppress the phenomenon of releasing electric charge when a PDP is manufactured. That is to say, it is shown that a lower Vscn lighting voltage means higher electric charge retention performance. This is advantageous in designing of a panel of a PDP because driving at a low voltage is possible. That is to say, as a power supply or electrical components of a PDP, components having a withstand voltage and a small capacity can be used. In current products, as semiconductor switching elements such as MOSFET for applying a scanning voltage to a panel sequentially, an element having a withstand voltage of about 150 V is used. Therefore, it is desirable that a Vscn lighting voltage is suppressed to not more than 120 V with considering the fluctuation due to temperatures.

Figure 7:
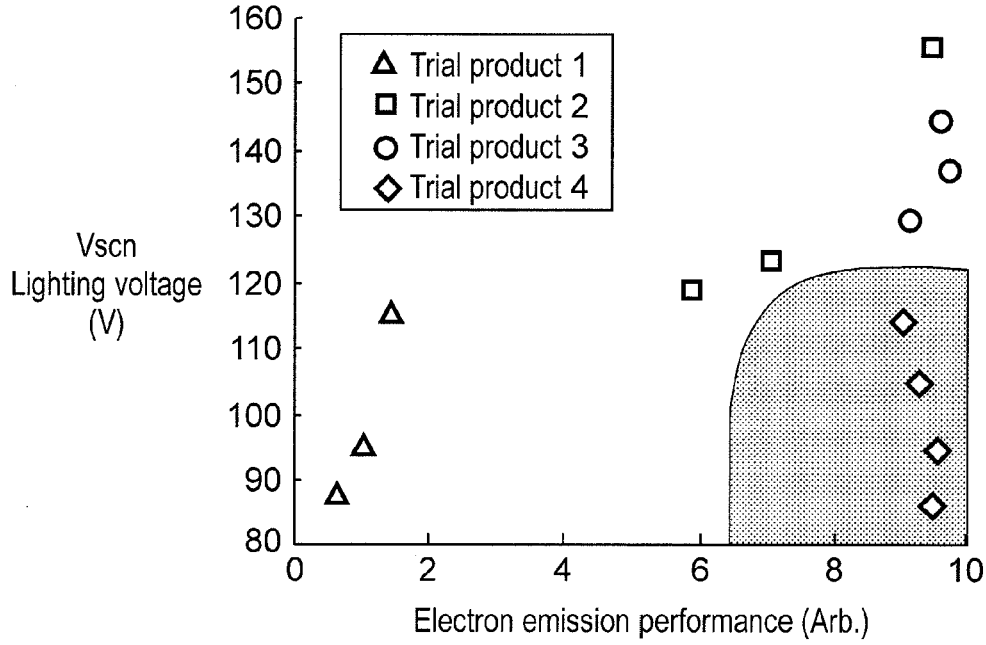
FIG. 7 is a graph showing an examination result of electron emission performance of a PDP and a Vscn lighting voltage in the result of experiment carried out to illustrate the effect by the present invention.

Results of examination of the electron emission performance and the electric charge retention performance are shown in FIG. 7. As is apparent from FIG. 7, trial product 4 of the present invention in which aggregated particles of aggregated single crystal particles of MgO are scattered on the base film made of MgO so that the aggregated particles are distributed over the entire surface substantially uniformly can achieve excellent properties: the Vscn lighting voltage can be set to not more than 120 V in the evaluation of the electric charge retention performance, and the electron emission performance shows not less than 6.

That is to say, in general, the electron emission performance and the electric charge retention performance of a protective layer of a PDP are conflicting with each other. The electron emission performance can be improved, for example, by changing the film formation condition of the protective layer or by forming a film by doping the protective layer with impurities such as Al, Si, and Ba. However, the Vscn lighting voltage is also increased as a side effect.

In a PDP including the protective layer in accordance with the exemplary embodiment of the present invention, the electron emission performance of not less than 6 and the Vscn lighting voltage as the electric charge retention performance of not more than 120 V can be achieved. Consequently, in a protective layer of a PDP in which according to the high definition, the number of scanning lines tends to increase and the cell size tends to be smaller, both the electron emission performance and the electric charge retention performance can be satisfied.

Next, the particle diameter of crystal particles used in the protective layer of a PDP in accordance with the exemplary embodiment of the present invention is described. In the below-mentioned description, the particle diameter denotes an average particle diameter, and the average particle diameter denotes a volume cumulative mean diameter (D50).

Figure 8:
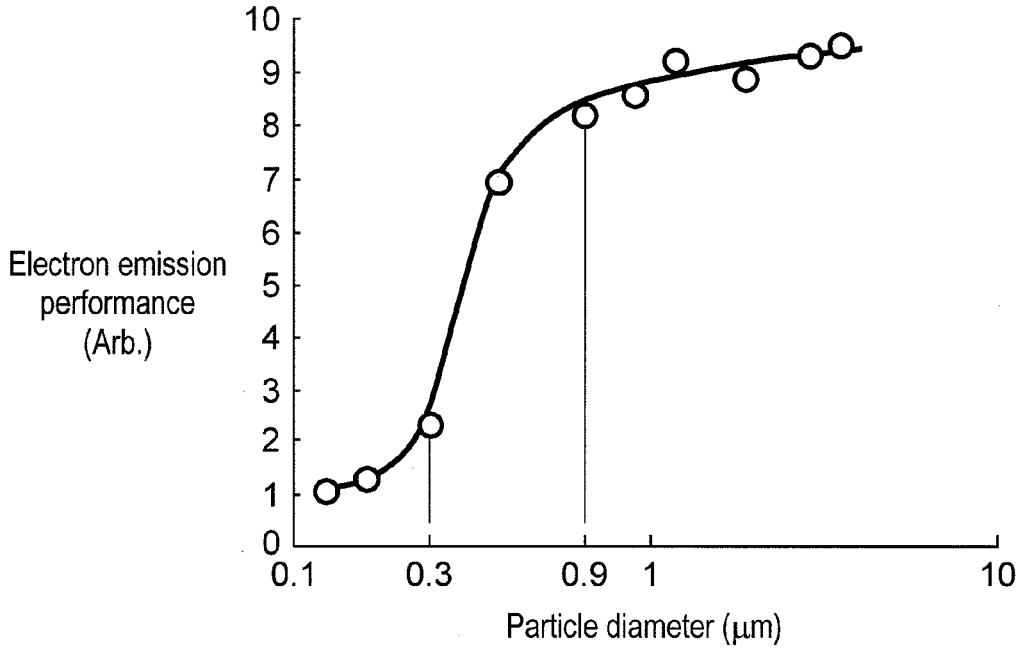
FIG. 8 is a graph showing a relation between a particle diameter of a crystal particle and the electron emission performance.

FIG. 8 shows a result of an experiment for examining the electron emission performance by changing the particle diameter of MgO crystal particle in trial product 4 in accordance with the present invention described with reference to FIG. 7 above. In FIG. 8, the particle diameter of MgO crystal particle is measured by SEM observation of crystal particles.

FIG. 8 shows that when the particle diameter is reduced to about 0.3 μm, the electron emission performance is reduced, and that when the particle diameter is substantially not less than 0.9 μm, high electron emission performance can be obtained.

In order to increase the number of emitted electrons in the discharge cell, it is desirable that the number of crystal particles per unit area on the base film is large. According to the experiment by the present inventors, when crystal particles exist in a portion corresponding to the top portion of the barrier rib on the rear panel that is in close contact with the protective layer of the front panel, the top portion of the barrier rib may be damaged. As a result, it is shown that the material may be put on a phosphor, causing a phenomenon that the corresponding cell is not normally lighted. The phenomenon that a barrier rib is damaged can be suppressed if crystal particles do not exist on the top portion corresponding to the barrier rib. Therefore, when the number of crystal particles to be attached increases, the rate of occurrence of the damage of the barrier rib increases.

Figure 9:
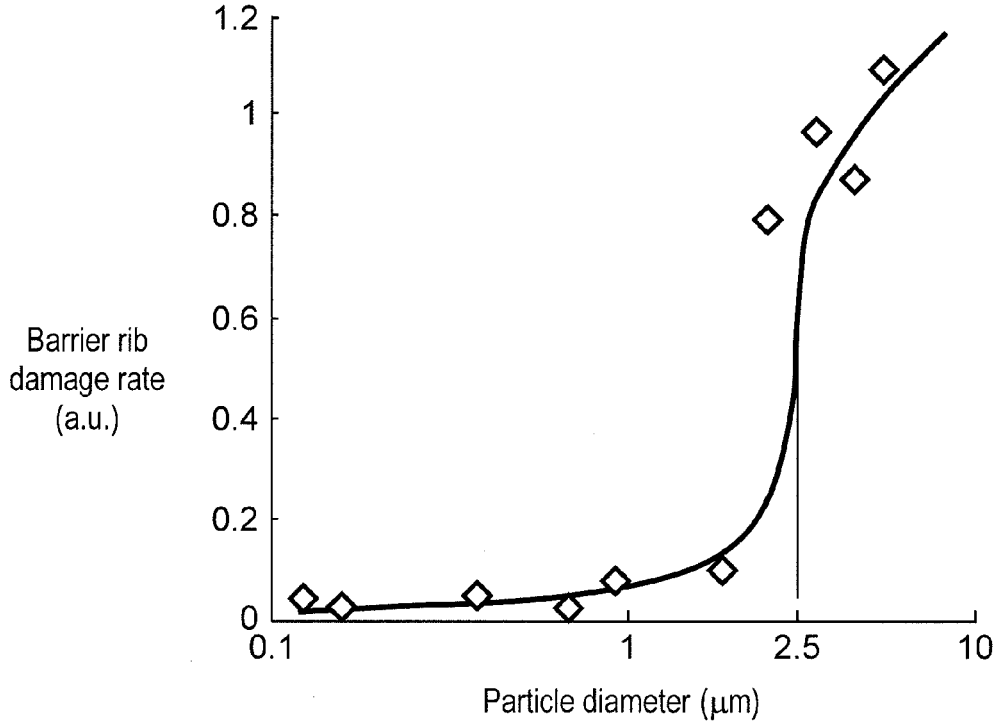
FIG. 9 is a graph showing a relation between a particle diameter of the crystal particle and the rate of occurrence of damage in a barrier rib.

FIG. 9 is a graph showing a result of an experiment for examining a relation between the particle diameter and the damage of the barrier rib when the same number of crystal particles having different particle diameters are scattered in a unit area in trial product 4 in accordance with the exemplary embodiment of the present invention described with reference to FIG. 7 above.

As is apparent from FIG. 9, it is shown that when the diameter of crystal particle increases to about 2.5 μm, the probability of the damage of the barrier rib rapidly increases but that when the diameter of crystal particle is less than 2.5 μm, the probability can be suppressed to relatively small.

Based on the above-mentioned results, it is thought to be desirable that crystal particles have a particle diameter of not less than 0.9 μm and not more than 2.5 μm in the protective layer of the PDP in accordance with the exemplary embodiment of the present invention. However, in actual mass production of PDPs, variation in manufacturing crystal particles or variation in forming protective layers need to be considered.

Figure 10:
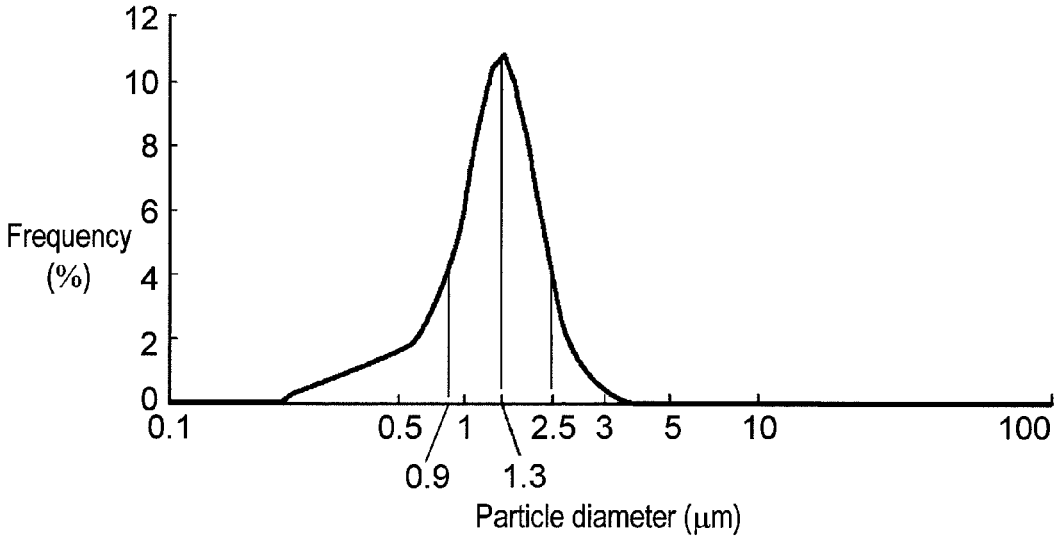
FIG. 10 is a graph showing an example of the particle size distribution of aggregated particles in a PDP in accordance with the present invention.

In order to consider the factors such as variation in manufacturing, an experiment using crystal particles having different particle size distributions is carried out. FIG. 10 is a graph showing one example of the particle size distribution of the aggregated particles in the PDP in accordance with the present invention. The frequency (%) shown in the ordinate is a rate (%) of the amount of aggregated particles existing in each of divided range of particle diameter shown in the abscissas with respect to the total amount. As a result of the experiment, as shown in FIG. 10, when aggregated particles having an average particle diameter of not less than 0.9 μm and not more than 2.5 μm are used, the above-mentioned effect of the present invention can be obtained stably.

As mentioned above, in the PDP including the protective layer in accordance with the exemplary embodiment of the present invention, the electron emission performance of not less than 6 and the Vscn lighting voltage as the electric charge retention performance of not more than 120 V can be achieved. That is to say, in a protective layer of a PDP in which according to the high definition, the number of scanning lines tends to increase and the cell size tends to be smaller, both the electron emission performance and the electric charge retention performance can be satisfied. Thus, a PDP having a high definition and high brightness display performance and also having low electric power consumption can be realized.

Next, manufacturing steps of forming a protective layer in a PDP in accordance with the exemplary embodiment of the present invention is described with reference to FIG. 11.

Figure 11:
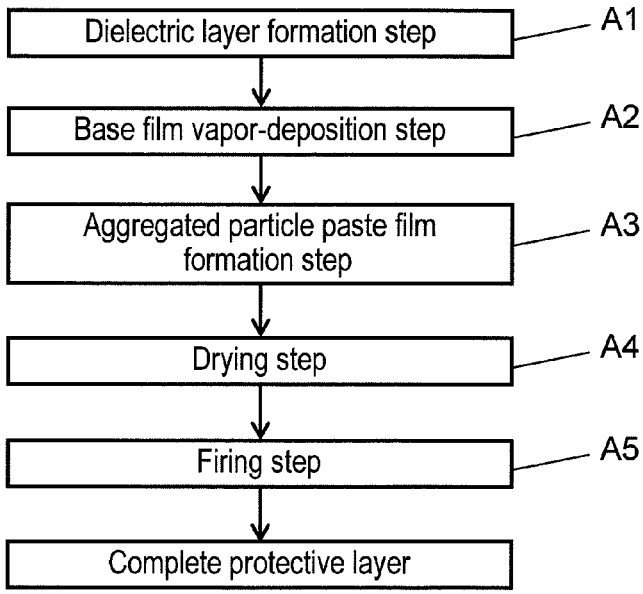
FIG. 11 is a chart showing steps of forming a protective layer in a method of manufacturing a PDP in accordance with the present invention.

As shown in FIG. 11, dielectric layer formation step A1 of forming dielectric layer 8 having a laminated structure of first dielectric layer 81 and second dielectric layer 82 is carried out. Then, in the following base film vapor-deposition step A2, a base film made of MgO is formed on second dielectric layer 82 of dielectric layer 8 by a vacuum deposition method using a sintered body of MgO containing aluminum (Al) as a raw material.

Then, a step of discretely attaching a plurality of aggregated particles to a non-fired base film formed in base film vapor deposition step A2 is carried out.

In this step, firstly, a crystal particle paste obtained by mixing single crystal particles of MgO having a predetermined particle size distribution together with a resin component into a solvent is prepared. Then, in paste film formation step A3, the crystal particle paste is coated on the non-fired base film by a printing method such as a screen printing method so as to form an aggregated particle paste film.

Thereafter, the non-fired base film formed in base film vapor deposition step A2 and the crystal particle paste film formed in crystal particle paste film formation step A3 and subjected to drying step A4 are fired simultaneously at a temperature of several hundred degrees in firing step A5. In firing step A5, the solvent or resin components remaining in the crystal particle paste film are removed, so that protective layer 9 in which aggregated particles 92 of a plurality of aggregated crystal particles 92*a* made of metal oxide are attached to base film 91 can be formed.

With this method, a plurality of aggregated particles 92 can be attached to base film 91 so that aggregated particles 92 are distributed over the entire surface substantially uniformly.

In the above description, as a protective layer, MgO is used as an example. However, performance required by the base is high sputter resistance performance for protecting a dielectric layer from ion bombardment, and electron emission performance is not required to be so high. In most of conventional PDPs, a protective layer containing MgO as a main component is formed in order to obtain predetermined level or more of electron emission performance and sputter resistance performance. However, for achieving a configuration in which the electron emission performance is mainly controlled by metal oxide single crystal particles, MgO is not necessarily used. Other materials such as $Al_2O_3$ having an excellent shock resistance property may be used.

In this exemplary embodiment, although MgO particles are used as single crystal particles, other simple crystal particles may be used. Since the same effect can be obtained even when other single crystal particles of oxide of metal such as Sr, Ca, Ba, and Al having high electron emission performance similar to MgO are used. Therefore, the kinds of particles are not limited to MgO.

INDUSTRIAL APPLICABILITY

As mentioned above, the present invention is useful in realizing a PDP having high definition and high brightness display performance and low electric power consumption.

The invention claimed is:

1. A plasma display panel comprising:

a front panel including a substrate, a display electrode formed on the substrate, a dielectric layer formed so as to cover the display electrode, and a protective layer formed on the dielectric layer;

a rear panel disposed facing the front panel, such that a discharge space is formed between the front panel and the rear panel, the rear panel including an address electrode formed in a direction intersecting the display electrode, and including a barrier rib partitioning the discharge space; and a seal material providing a seal between the front panel and the rear panel at outer peripheries of the front panel and the rear panel, wherein the protective layer is formed by forming a base film on the dielectric layer and attaching a plurality of groups of aggregated particles to the base film, wherein each group of aggregated particles of the plurality of groups of aggregated particles is (i) in a lump form and (ii) comprises a plurality of metal oxide crystal particles piled up to form the lump form, and wherein each group of aggregated particles of the plurality of groups of aggregated particles is located discretely over a surface of a region inside the seal material.

2. The plasma display panel of claim 1, wherein each group of aggregated particles of the plurality of groups of aggregated particles is attached to the base film, such that an outer edge portion of the region to which the plurality of groups of aggregated particles is attached is located in a non-display area of the plasma display panel provided between a display area and the seal material.

3. The plasma display panel of claim 1, wherein each metal oxide crystal particle of the plurality of metal oxide crystal particles of each group of aggregated particles of the plurality of groups of aggregated particles has an average particle diameter of not less than 0.9 μm and not more than 2.5 μm.

4. The plasma display panel of claim 1, wherein each group of aggregated particles of the plurality of groups of aggregated particles is located discretely over an entire surface of a region inside the seal material.

5. The plasma display panel of claim 1, wherein each group of aggregated particles of the plurality of groups of aggregated particles is located discretely over an entire surface of a region inside the seal material substantially uniformly.

* * * * *